United States Patent [19]

Devoy

[11] Patent Number: 4,681,428

[45] Date of Patent: Jul. 21, 1987

[54] APPARATUS FOR PRODUCING INTERLEAVED COPY SHEETS

[75] Inventor: James M. Devoy, Rochester, N.Y.

[73] Assignee: Eastman Kodak Company, Rochester, N.Y.

[21] Appl. No.: 850,643

[22] Filed: Apr. 11, 1986

[51] Int. Cl.[4] ..... G03G 15/00

[52] U.S. Cl. ..... 355/3 SH; 355/3 R; 355/14 SH; 355/64

[58] Field of Search ..... 355/3 SH, 3 R, 14 SA, 355/64, 38 E, 16, 64, 78, 97, 100, 133; 271/279, 287, 288, 298, 303, 64

[56] References Cited

U.S. PATENT DOCUMENTS

| | | | |
|---|---|---|---|
| 4,072,420 | 2/1978 | Wicks et al. | 355/100 |
| 4,211,483 | 7/1980 | Hannigan et al. | 355/14 R |
| 4,285,591 | 8/1981 | Botte et al. | 355/14 C |
| 4,436,404 | 3/1984 | Simmons et al. | 355/3 SH |
| 4,469,322 | 9/1984 | Kogure et al. | 355/3 SH X |
| 4,528,056 | 7/1985 | Hunt et al. | 355/3 SH X |
| 4,531,823 | 7/1985 | Deguchi et al. | 355/3 R |
| 4,534,643 | 8/1985 | Watanabe | 355/3 SH |
| 4,609,282 | 9/1986 | Crandall | 355/3 SH |

*Primary Examiner*—A. C. Prescott

*Attorney, Agent, or Firm*—Milton S. Sales

[57] ABSTRACT

Means are disclosed for alternately presenting copy sheets of either a first characteristic or a second characteristic to an image receiving position from respective first and second copy sheet supplies. A set of document originals are sequentially copied onto copy sheets presented at the image receiving position, with copies of successive document originals of the set being copied onto successive copy sheets from the first supply. Copy sheets from the second supply may be left blank or may receive images of successive document originals of the set such that each original is copied multiple times, at least once onto a copy sheet of the first characteristic and at least once onto a copy sheet of the second characteristic.

9 Claims, 5 Drawing Figures

FIG. 2
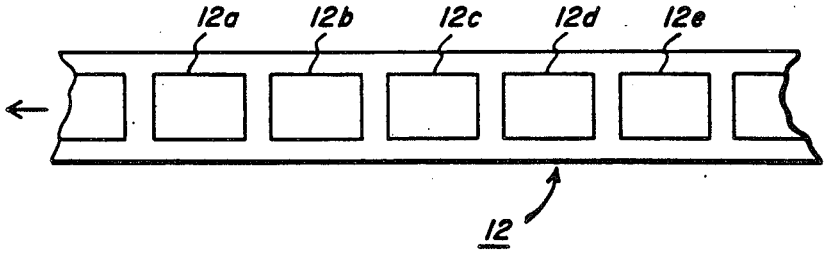
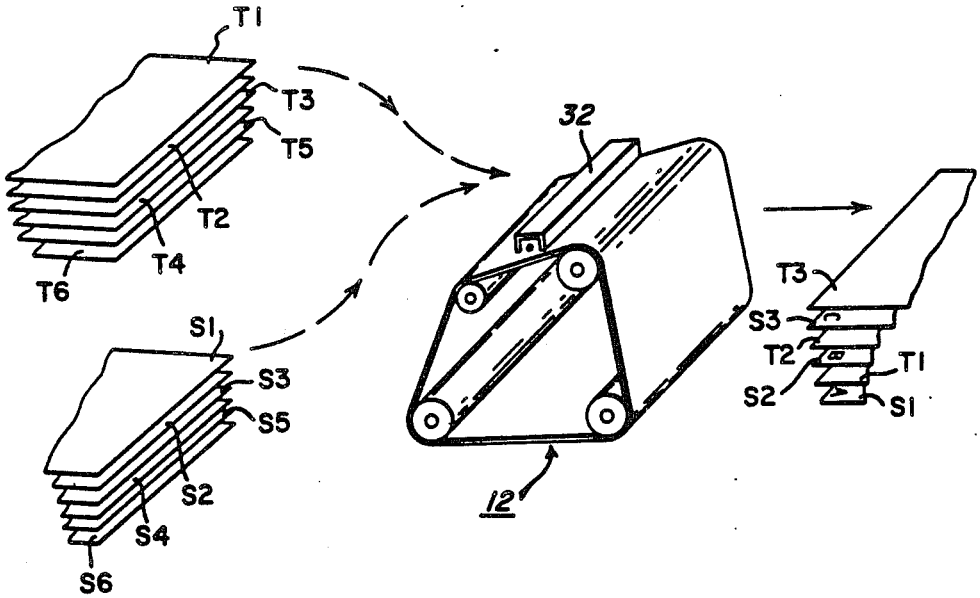
FIG. 3

APPARATUS FOR PRODUCING INTERLEAVED COPY SHEETS

BACKGROUND OF THE INVENTION

1. Field of the Invention

This invention relates generally to producing information copies on interleaved copy sheets of first and second characteristics such as for example copy sheets of transparency material and of plain paper separator sheets.

2. Description of the Prior Art

One popular medium for communicating information involves displaying the desired information to be communicated on a projection screen so as to be visible to a substantial number of persons at the same time. Such information is contained on sheets of transparency material (such sheets being herein referred to as "transparencies") and is projected therefrom onto the screen, for example, by a projector commonly referred to as an overhead projector. Transparencies are typically prepared by producing copies of original information on transparency material in a reproduction apparatus such as a printer or electrographic copier.

Transparencies, however, have proven difficult to handle during use. A principle reason for this difficulty has to do with certain inherent characteristics of transparency material. That is, transparency material typically comprises nonfibrous, flexible polymeric sheets which have a relatively high coefficient of friction and a high propensity to surface electrostatic charge build-up. Transparencies tend to stick together due to such charge build-up and are hard to feed individually through the reproduction apparatus.

The solution to this problem has commonly been to interleave plain paper separator sheets between adjacent transparencies. The separator sheets may be blank or contain the same information as the adjacent transparency. In either case, the interleaving process has been done after the copy process, and is a tedious and time consuming job.

SUMMARY OF THE INVENTION

In accordance with the present invention, means are provided for alternately presenting copy sheets of either a first characteristic or a second characteristic to an image receiving position from respective first and second copy sheet supplies. A set of document originals are sequentially copied onto copy sheets presented at the image receiving position, with copies of successive document originals of the set being copied onto successive copy sheets presented from the first supply.

In one embodiment of the invention, copy sheets from the second supply are left blank, while in a second embodiment copy sheets from the second supply receive images of successive document originals of the set such that each original is copied multiple times, at least once onto a copy sheet of the first characteristic and at least once onto a copy sheet of the second characteristic. In a third embodiment, copy sheets from the second supply may selectively be left blank or may receive an image, as desired.

A preferred use for apparatus in accordance with the present invention is the production of information copies of interleaved transparencies and plain paper separator sheets. However, other uses of the invention will occur to those skilled in the art, such as for example interleaving forms copied on so-called carbonless paper with forms copied on standard (noncarbonless) paper.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 2 is a view of the photoconductive web of the reproduction apparatus of FIG. 1 laid out in planar form, and FIGS. 3 through 5 are schematic diagrams of respective modes of operation of the reproduction apparatus of FIG. 1, according to this invention.

DESCRIPTION OF THE PREFERRED EMBODIMENTS

Figure 1:
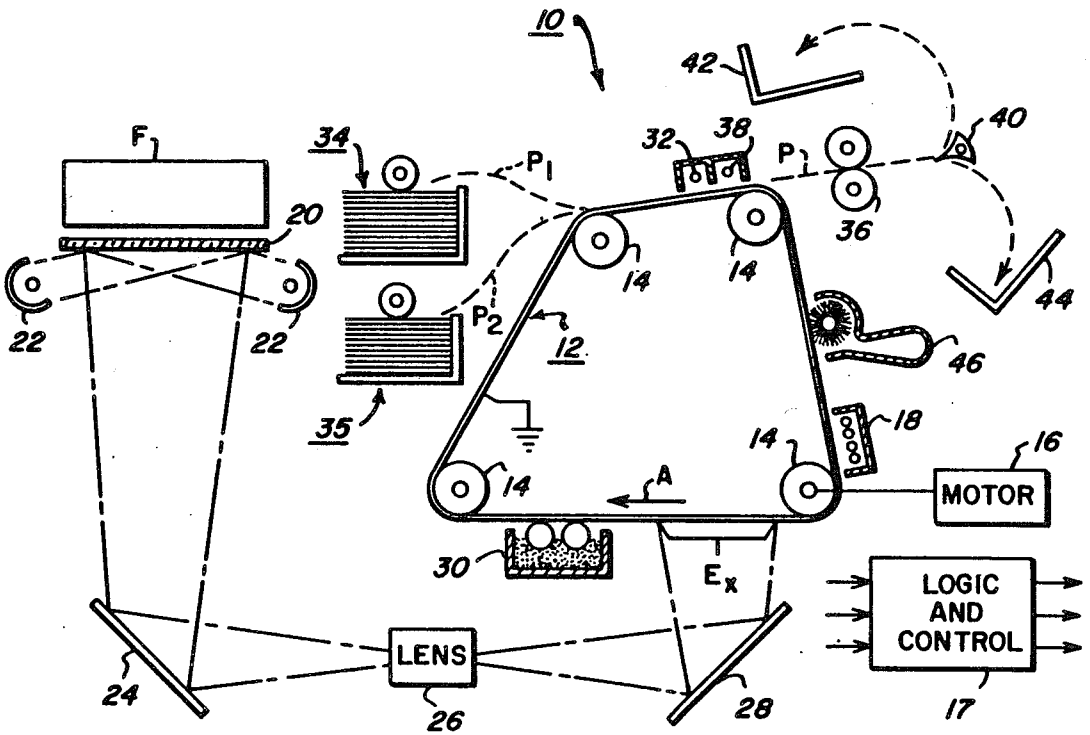
FIG. 1 is a schematic illustration of a electrographic reproduction apparatus for producing information copies according to this invention.

Referring now to the accompanying drawings, an electrographic reproduction apparatus, designated generally by the numeral 10, is schematically shown in FIG. 1. Reproduction apparatus 10 includes an endless composite web 12 having a photoconductive surface layer and a grounded conductive support layer, such as shown for example in U.S. Pat. No. 3,615,414, issued Oct. 26, 1971, in the name of Light. Web 12, upon which a plurality of images **12*a*–12*e* may be exposed, is supported on rollers 14, one of which is selectively driven by a motor 16 to move the web about a closed loop path in the direction of arrow A. Typical electrographic process stations are located about the periphery of web 12** in operative relation with the image receiving areas.

Control of reproduction apparatus 10 and of the electrographic process stations are accomplished by a logic and control unit (LCU) 17 including for example a microprocessor. The microprocessor receives operator input signals and timing signals, for example from sensors (not shown) detecting movement of the film web 12 about its closed loop path. Based on such signals and a program for the microprocessor, LCU 17 produces signals to control the timing operation of the various electrographic process stations for carrying out the reproduction process. The production of a program for a number of commercially available microprocessors such as INTEL model 8080 or model 8085 microprocessor (which along with others are suitable for use with the invention) is a conventional skill well understood in the art. The particular details of any such program would, of course, depend on the architecture of the designated microprocessor.

The electrographic process stations function in the following manner. A corona charger 18, coupled to an electrical potential source (not shown), applies a uniform electrostatic charge to the web as it moves past the charger. The uniform charge, in an image receiving area, is altered as the web passes through zone $E_x$ to form an image-wise charge pattern in such area corresponding to information to be copied. For example, the charge pattern is formed by exposure of the image-receiving area of the web to a reflected light image of such information. In the illustrated apparatus 10, exposure is accomplished by utilizing a feeder F, such as described in U.S. Pat. No. 4,169,674 issued Oct. 2, 1979 in the name of Russel, to transport document originals to a transparent platen 20, information face down. Light from lamps 22 reflects off the document originals, and an image of the information thereon is projected via a mirror 24, a lens 26, and a mirror 28 onto the web in an image receiving area at zone $E_x$. Although the document originals described in the preferred embodiment are hard copy paper, it is to be understood that the term "document original", as used herein, refers to any form of information to be reproduced, such as for example electronically coded data or text.

A developer station 30, such as a magnetic brush described in U.S. Pat. No. 3,457,900 issued July 29, 1969 in the name of Drexler, brings marking particles into contact with the moving web. Such particles adhere to the charge pattern to develop the pattern.

The image receiving area containing the developed charge pattern travels about the closed loop path to an image receiving position including a transfer station 32 having a corona charger coupled to a D.C. or biased A.C. potential source for example. A receiver member is fed from one of supply hoppers 34 and 35 and transported along a path $P_1$ or $P_2$, respectively, to the transfer station in timed relation with moving web so that the receiver member is in register with the developed charge pattern. The charger of the transfer station 32 effects transfer of the developed charge pattern from the image receiving area of web 12 to the receiver member. After transfer, the receiver member is stripped from the web and transported along path P to a fuser assembly 36, where the transferred pattern is fixed to such member by heat and/or pressure for example. Stripping of the receiver member is facilitated by a corona charger 38, coupled to an A.C. potential source, which neutralizes electrostatic forces holding the receiver member to the web. After the pattern is fixed to the receiver member, the member is directed by a movable deflector 40 to be delivered to one of output hoppers 42 or 44, as will be more fully discussed hereinbelow, for operator retrieval. Substantially simultaneously, web 12 moves through a cleaning station 44, where residual (non-transferred) marking particles are removed by a rotating brush for example, and returned to the area of charger 18 to be conditioned for reuse.

When reproduction apparatus 10 is utilized for producing and stacking information copies alternately on copy sheets of first and second characteristics, hopper 34 contains a stack of copy sheets of one characteristic and hopper 35 contains a stack of copy sheets of the other characteristic. For example, hopper 34 may contain transparency material and hopper 35 may contain plain paper separator sheets to facilitate sheet handling of the copies by reducing the effect of the high coefficient of friction of the transparency material and by preventing transparency material from sticking together due to surface charge build-up. As another example, hopper 34 may contain plain paper and hopper 35 may contain so-called carbonless paper.

Figure 4:
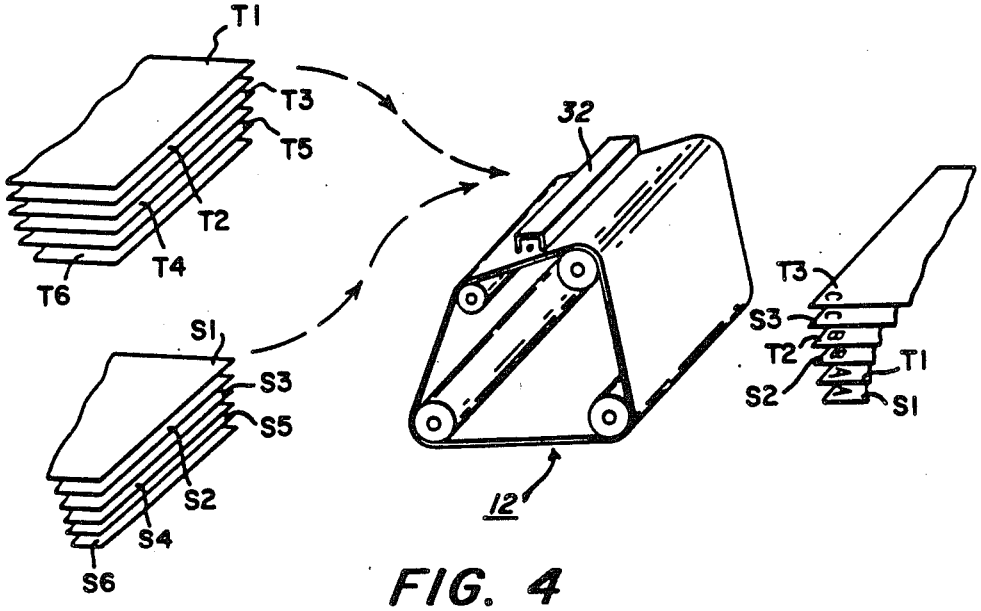

FIGS. 3 and 4 schematically show respective improved operating modes for apparatus 10, under the control of LCU 17 for producing and stacking such information copies. In such figures, transparency material is designated by the letter T and the plain paper separator sheets are designated by the letter S.

In one mode of operation (FIG. 3), developed charge patterns corresponding to respective original information are formed in alternate image receiving areas of web 12 (e.g. 12*a*, 12*c*, 12*e*). Transparency material (e.g. $T_1$, $T_2$, $T_3$) and plain paper separator sheets (e.g. $S_1$, $S_2$, $S_3$) are alternately fed seriatim through transfer station 32 of the reproduction apparatus. LCU 17 controls the timing of transparency material and separator sheet feeding relative to web movement such that the developed charge patterns are respectively transferred only to the transparency material, and the separator sheets are left blank. As used herein, the term "blank" does not exclude copy sheets which may contain a preprinted pattern, design, or information. Deflector 40 (FIG. 1) is fixed in one position to direct both the transparency material and separator sheets to one output hopper (i.e. hopper 42 if deflector 40 is in solid line position of FIG. 1, or hopper 44 if the deflector is in phantom line position). Thus, the transparency material and separator sheets are restacked in an interleaved fashion with information copies produced only on the transparency material. In this manner, the restacked transparency material bearing information copy is prevented from sticking together, due to the static charge build-up, by the interleaved plain paper separator sheets.

Under some circumstances, it is desirable to produce information copies on the plain paper separator sheets as well as on transparency material. Therefore, a second mode of operation (FIG. 4), developed charge patterns corresponding to respective original information to be reproduced, are formed in each image receiving area of the web 12. Each item of the set of originals is held on the platen for two exposure cycles so that the same information appears in two adjacent image receiving areas (e.g. 12*a*, 12*b*). Thus, when the transparency material and plain paper separator sheets are fed seriatim through the transfer station 32, under the control of LCU 17, developed charge patterns are transferred to both the transparency material and the separator sheets, with the same information reproduced on a sheet of transparency material and its immediately preceeding (or following) separator sheet. Deflector 40 remains fixed in one position to direct the transparency material and separator sheets to one output hopper. Accordingly, the transparency material and plain paper separator sheets are restacked, in order with duplicate information copies following one another, in interleaved fashion.

It may be desirable to feed copy sheets such that one or more sheets from one supply are grouped and interleaved with groups of one or more sheets from the other supply. For example, an original may be copied onto several carbonless paper sheets and then once onto a plain paper sheet. This process is repeated for each original.

Figure 5:
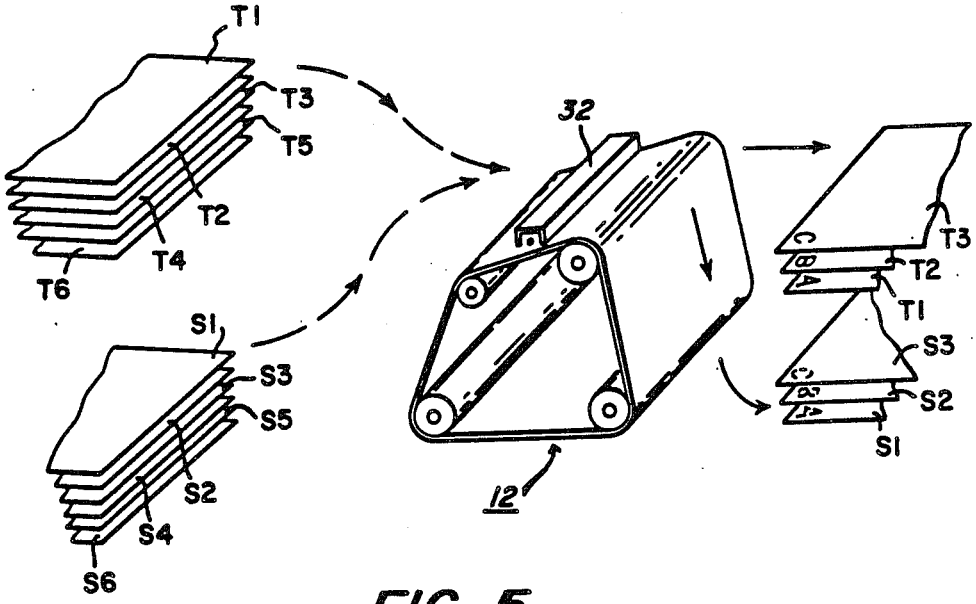

In a fourth mode of operation (FIG. 5), information copies are similarly produced as in the second mode of operation on both transparency material and plain paper separator sheets, and deflector 40 is alternately moved to its solid line and phantom line position in timed relation to the travel of transparency material and plain paper separator sheets to direct the transparency material to one outlet hopper and the separator sheets to the other outlet hopper. Accordingly, transparency material bearing information copies are stacked in order in one output hopper, and plain paper separator sheets bearing information copies are stacked in order in the other output hopper.

The invention has been described in detail with particular reference to the preferred embodiment thereof, but it will be understood that variations and modifications can be effected within the spirit and scope of the invention.

I claim:

1. In apparatus including (1) means for selectively presenting copy sheets of either a first characteristic or a second characteristic to an image receiving position and (2) means for sequentially copying a set of originals onto copy sheets presented at the image receiving position; the improvement comprising:

first and second supplies of copy sheets of the first and second characteristics, respectively; and control means for (1) causing the presenting means to alternately present copy sheets from said first and second supplies to the image receiving position, and (2) causing the copying means to produce copies of successive originals of the set onto successive copy sheets presented to the image receiving position from said first supply.

2. The improvement as defined in claim 1 wherein said control means causes the copying means also to produce copies of successive originals of the set onto successive copy sheets presented to the image receiving position from said second supply, whereby each original is copied twice, once onto a copy sheet of the first characteristic and once onto an adjacent copy sheet of the second characteristic.

3. The improvement as defined in claim 1 further comprising means for stacking the copy sheets after presentation to the image receiving means with copy sheets of the first characteristic interleaved with copy sheets of the second characteristic.

4. The improvement as defined in claim 3 wherein said control means causes the copying means also to produce copies of successive originals of the set onto successive copy sheets presented to the image receiving position from said second supply, whereby the stack contains adjacent copies of the same original, one copy on a copy sheet of the first characteristic and one copy on a copy sheet of the second characteristic.

5. In apparatus including (1) means for selectively presenting transparency and plain paper separator sheet copy sheets to an image receiving position and (2) means for sequentially producing images of a set of originals onto copy sheets presented at the image receiving position; the improvement comprising:

first and second supplies of transparency and plain paper separator sheet copy sheets, respectively; and control means for (1) causing the presenting means to alternately present copy sheets from said first and second supplies to the image receiving position, and (2) causing the producing means to produce copies of successive originals of the set onto successive transparency copy sheets presented to the image receiving position from said first supply.

6. The improvement as defined in claim 5 wherein said control means causes the producing means also to produce copies of successive originals of the set onto successive plain paper separator sheet copy sheets presented to the image receiving position from said second supply, whereby each original is imaged twice, once onto a transparency copy sheet and once onto an adjacent plain paper separator copy sheet.

7. The improvement as defined in claim 5 further comprising means for stacking the copy sheets after presentation to the image receiving means with transparency copy sheets interleaved with plain paper separator sheet copy sheets.

8. The improvement as defined in claim 7 wherein said control means causes the producing means also to produce copies of successive originals of the set onto successive plain paper separator sheet copy sheets presented to the image receiving position from said second supply, whereby the stack contains adjacent copies of the same original, one copy on a transparency copy sheet and one copy on a plain paper separator sheet copy sheet.

9. In apparatus including (1) means for selectively presenting copy sheets of either a first characteristic or a second characteristic to an image receiving position and (2) means for sequentially copying a set of originals onto copy sheets presented at the image receiving position; the improvement comprising:

first and second supplies of copy sheets of the first and second characteristics, respectively; and control means for (1) causing the presenting means to present copy sheets from said first and second supplies to the image receiving position, (2) causing the copying means to produce copies of successive originals of the set onto copy sheets presented to the image receiving position from said first supply; and (3) causing the copying means to produce copies of successive originals of the set onto copy sheets presented to the image receiving position from said second supply, whereby each original is copied multiple times, at least once onto a copy sheet of the first characteristic and at least once onto a copy sheet of the second characteristic.

* * * * *